US006418735B1

(12) United States Patent
Sienel

(10) Patent No.: US 6,418,735 B1
(45) Date of Patent: Jul. 16, 2002

(54) HIGH PRESSURE REGULATION IN TRANSCRITICAL VAPOR COMPRESSION CYCLES

(75) Inventor: Tobias H. Sienel, Manchester, CT (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/713,094

(22) Filed: Nov. 15, 2000

(51) Int. Cl.[7] ..... F25B 39/04
(52) U.S. Cl. ..... 62/115; 62/196.4
(58) Field of Search ..... 62/196.4, 506, 62/507, 115

(56) References Cited

U.S. PATENT DOCUMENTS 3,069,867 A * 12/1962 Ringquist ..... 62/196.4
3,370,438 A * 2/1968 Hopkinson ..... 62/196.4
3,481,152 A * 12/1969 Seeley ..... 62/196.4
4,123,914 A * 11/1978 Perez et al. ..... 62/196.4
4,136,528 A * 1/1979 Vogel et al. ..... 62/196.4
4,984,433 A * 1/1991 Worthington ..... 62/196.4
5,245,836 A 9/1993 Lorentzen et al.
5,309,728 A * 5/1994 Chae ..... 62/196.4
5,685,160 A 11/1997 Abersfelder et al.

FOREIGN PATENT DOCUMENTS

WO WO 99/08053 2/1999
WO WO 99/34156 7/1999

* cited by examiner

*Primary Examiner*—William E. Tapolcai
(74) *Attorney, Agent, or Firm*—Carlson Gaskey & Olds

(57) ABSTRACT

A valve located at the exit of at least one of two circuits in a gas cooler in a vapor compression system controls the high pressure of the system. The high pressure of the system can be regulated by controlling the actuation of the valve. Closing the valve will accumulate and store charge in the gas cooler, increasing the pressure in the gas cooler. Opening the valve will release charge and reduce the gas cooler pressure. By controlling the actuation of the valve, the high pressure component of the system can be regulated, also regulating the enthalpy of the system to achieve optimal efficiency and/or capacity. Carbon dioxide is preferably used as the refrigerant.

14 Claims, 2 Drawing Sheets

HIGH PRESSURE REGULATION IN TRANSCRITICAL VAPOR COMPRESSION CYCLES

BACKGROUND OF THE INVENTION

The present invention relates generally to a means for regulating the high pressure component of a transcritical vapor compression system.

Chlorine containing refrigerants have been phased out in most of the world due to their ozone destroying potential. Hydrofluoro carbons (HFCs) have been used as replacement refrigerants, but these refrigerants still have high global warming potential. "Natural" refrigerants, such as carbon dioxide and propane, have been proposed as replacement fluids. Unfortunately, there are problems with the use of many of these fluids as well. Carbon dioxide has a low critical point, which causes most air conditioning systems utilizing carbon dioxide as a refrigerant to run transcritical under most conditions.

When a vapor compression system is run transcritical, it is advantageous to regulate the high pressure component of the system. By regulating the high pressure of the system, the capacity and/or efficiency of the system can be controlled and optimized. Increasing the high pressure of the system (gas cooler pressure) lowers the specific enthalpy of the refrigerant entering the evaporator and increases capacity. However, more energy is expended because the compressor must work harder. It is advantageous to find the optimal high pressure of the system, which changes as operating conditions change. By regulating the high pressure component of the system, the optimal high pressure can be selected.

Hence, there is a need in the art for a means for regulating the high pressure component of a transcritical vapor compression system.

SUMMARY OF THE INVENTION

The present invention relates to a means for regulating the high pressure component of a transcritical vapor compression system.

A vapor compression system consists of a compressor, a heat rejection heat exchanger, an expansion device, and a heat absorbing heat exchanger. The high pressure of the system is regulated by a controllable valve connected at the exit of one or more gas cooler circuits. In a preferred embodiment of the invention, carbon dioxide is used as the refrigerant.

This invention regulates high pressure component of the vapor compression (pressure in the gas cooler) by controlling the actuation of a valve located at the exit of one or more of the gas cooler circuits. Closing the valve turns one of the circuits into a dead end volume which accumulates and stores charge, reducing the effective heat transfer area and increasing the gas cooler pressure. Opening the valve releases charge and the gas cooler pressure is reduced.

By controlling the actuation of the valves, the high pressure component of the system is regulated, controlling the enthalpy of the system to achieve optimal efficiency and/or capacity.

Accordingly, the present invention provides a method and system for regulating the high pressure component of a transcritical vapor compression system.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
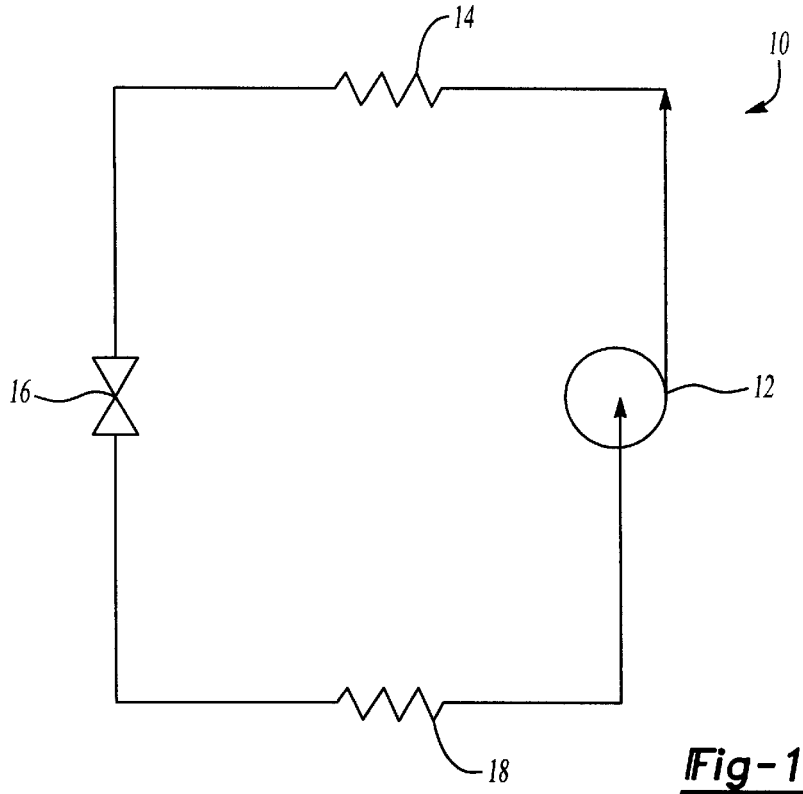
Fig-1 PRIOR ART
FIG. 1 illustrates a schematic diagram of a prior art vapor compression system.

While the invention may be susceptible to embodiments in different forms, there is shown in the drawings, and herein will be described in detail, specific embodiments with the understanding that the present disclosure is to be considered an exemplification of the principles of the invention, and is not intended to limit the invention to that as illustrated and described herein.

FIG. 1 illustrates a prior art vapor compression system 10. A basic vapor compression system 10 consists of a compressor 12, a heat rejecting heat exchanger (a gas cooler in transcritical cycles) 14, an expansion device 16, and a heat accepting heat exchanger (an evaporator) 18.

Refrigerant is circulated though the closed circuit cycle 10. In a preferred embodiment of the invention, carbon dioxide is used as the refrigerant. While carbon dioxide is illustrated, other refrigerants may be used. Because carbon dioxide has a low critical point, systems utilizing carbon dioxide as a refrigerant require the vapor compression system 10 to run transcritical under most conditions.

When the system 10 is run transcritical, it is advantageous to regulate the high pressure component of the vapor compression system 10. By regulating the high pressure of the system 10, the capacity and/or efficiency of the system 10 can be controlled and optimized. Increasing the gas cooler 14 pressure lowers the enthalpy of the refrigerant entering the evaporator 18 asnd increases capacity, but also requires more energy because the compressor 16 must work harder. By regulating the high pressure of the system 10, the optimal pressure of the system 10, which changes as the operating conditions change, can be selected.

Figure 2:
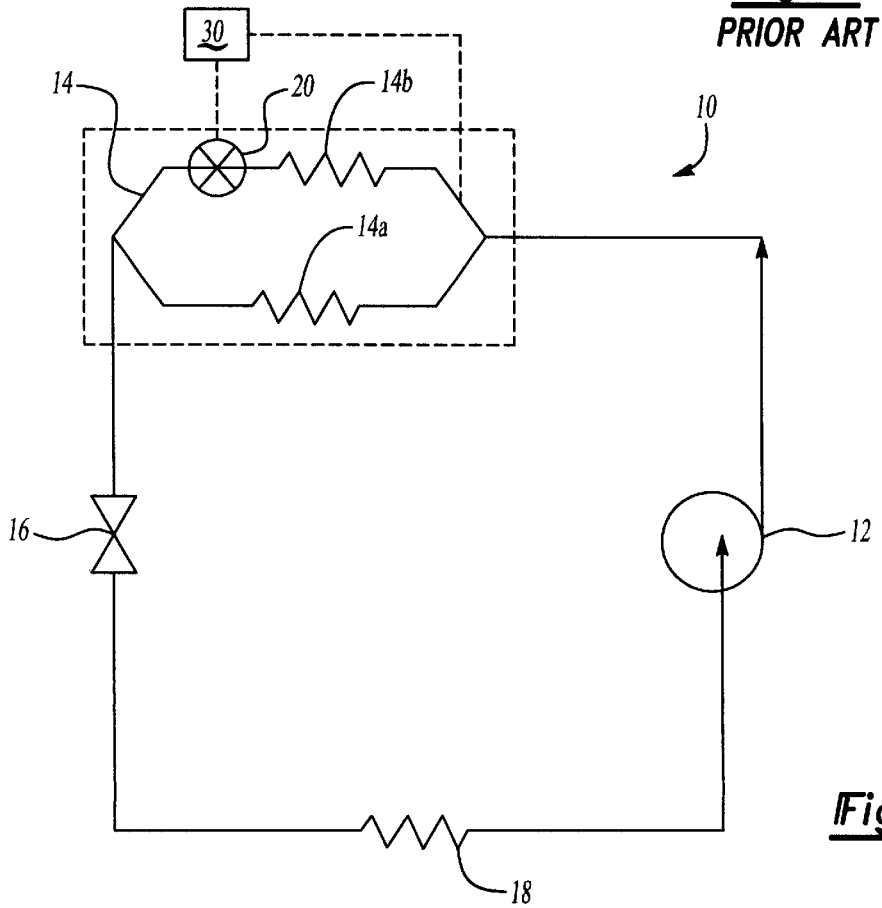
FIG. 2 illustrates a schematic diagram of a vapor compression system utilizing a valve located at the exit of one of the gas cooler circuits.

FIG. 2 illustrates a vapor compression system 10 with a gas cooler 14 having two circuits 14*a* and 14*b*. This invention regulates the high pressure component of the vapor compression system 10 by blocking the passage of charge though at least one circuit 14*b* of the gas cooler 14. A controllable valve 20 is located at the exit of a gas cooler circuit 14*b* and regulates the flow of charge exiting from the gas cooler circuit 14*b*. A valve is not located at the exit of gas cooler circuit 14*a*. Although FIG. 2 illustrates a gas cooler 14 with two circuits 14*a* and 14*b*, the gas cooler 14 can include any number of circuits. Valves 20 can also be connected at the exit of any or all of the circuits of the gas cooler 14. By regulating the high pressure in the gas cooler 14 before expansion, the enthalpy of the refrigerant at the entry of the evaporator can be modified, controlling capacity of the system 10.

In the disclosed embodiment, a control 30 senses pressure in the cooler 14 and controls the valve 20. The control 30 may be the main control for cycle 10. Control 30 is programmed to evaluate the state the cycle 10 and determine a desired pressure in cooler 14. Once a desired pressure has been determined, the valve 20 is controlled to regulate the pressure. The factors that would be used to determine the optimum pressure are within the skill of a worker in the art.

Figure 3:
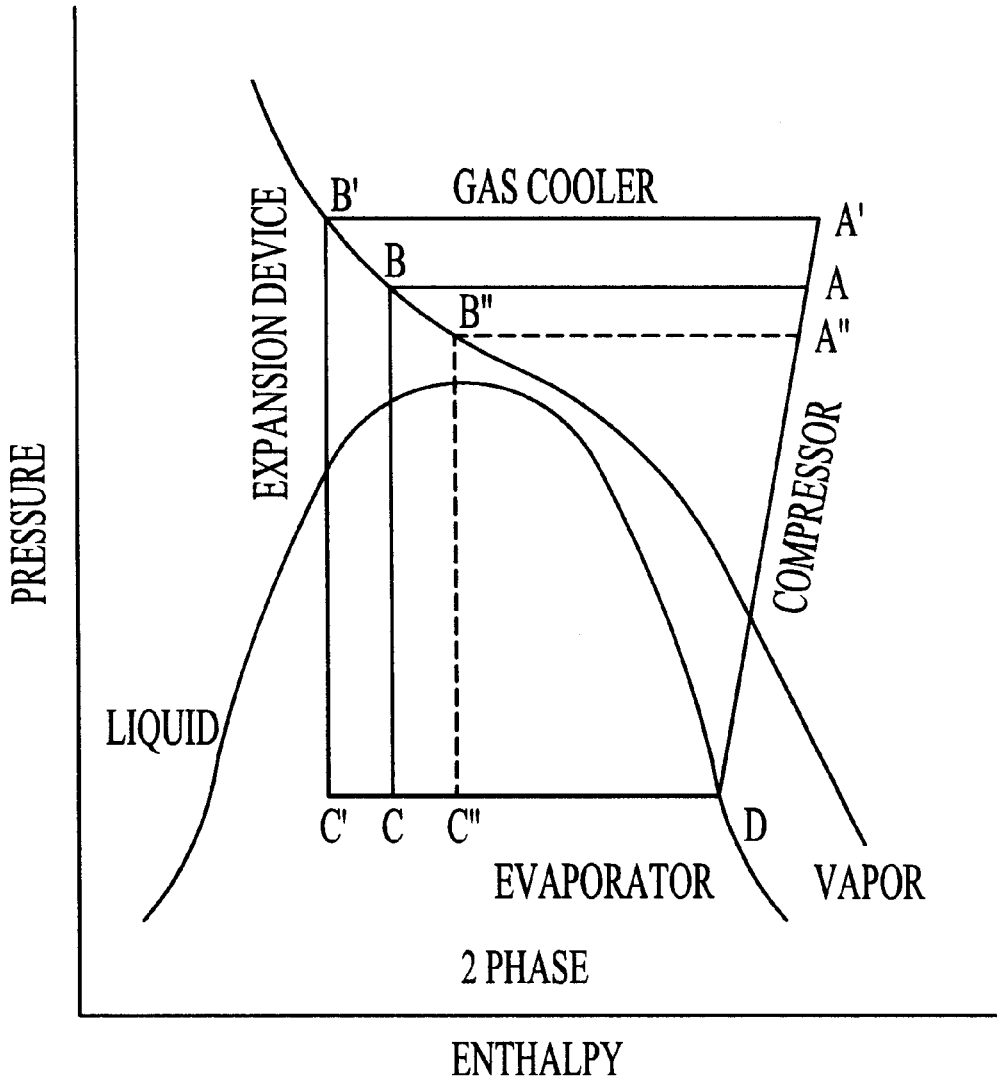
FIG. 3 illustrates a thermodynamic diagram of a transcritical vapor compression system.

In a cycle of the vapor compression system 10, the refrigerant exits the compressor 12 at high pressure and enthalpy, shown by point A in FIG. 3. As the refrigerant flows through the gas cooler 14 at high pressure, it loses heat and enthalpy, exiting the gas cooler 14 with low enthalpy and high pressure, indicated as point B. As the refrigerant passes through the expansion device 16, the pressure drops to point C. After expansion, the refrigerant passes through the evaporator 18 and exits at a high enthalpy and low pressure, represented by point D. After the refrigerant passes through the compressor 12, it is again at high pressure and enthalpy, completing the cycle.

The high pressure of the system 10, and the pressure in the gas cooler 14, is regulated by adjusting a valve 20 located at the exit or one or more of the circuits of the gas cooler 14. The actuation of the valve 20 is regulated by control 30 monitoring the high pressure of the system 10.

If the pressure in the gas cooler 14 is lower than optimum, the refrigerant enters the evaporator 18 at a high enthalpy, and the system 10 is running at low capacity and/or efficiency. If control 30 determines the pressure is lower that desired, valve 20 is closed to accumulate charge in the gas cooler 14 in dead end 14*b* and increases the pressure to the optimal pressure. This increases the pressure in the gas cooler 14 from A to A', and the refrigerant enters the evaporator 18 at a lower enthalpy, represented by point C' in FIG. 3.

Alternately, if the pressure in the gas cooler 14 is higher than desired, the system 10 is using too much energy. If control 30 determines the pressure is higher that desired, valve 20 is opened and excess charge flows through circuit 14*b* from the gas cooler 14 to the system 10, lowering the gas cooler 14 pressure to A". The refrigerant enters the evaporator 18 at a higher enthalpy, shown by point C", and less energy is used to run the cycle. By regulating the high pressure in the gas cooler 14 to the optimal pressure by adjusting a valve 20, the enthalpy can be modified to achieve optimal capacity.

Accordingly, the present invention provides a valve to control the high pressure in a transcritical vapor compression cycles. Control 30 may be a microprocessor based control, or other control known in the art of refrigerant cycles.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. An apparatus for regulating a high pressure of a refrigerant circulating in a transcritical vapor compression system comprising:

a heat rejecting heat exchanger for cooling said refrigerant, said heat rejecting heat exchanger having at least two circuits;

a valve located on at least one said circuit of said heat rejecting heat exchanger; and a controller which monitors said high pressure, determines a desired high pressure, and adjusts said high pressure to said desired high pressure by adjusting said valve.

2. The apparatus as recited in claim 1 wherein said valve is opened to regulate flow of charge through said at least one circuit of said heat rejecting heat exchanger and decrease said high pressure of said refrigerant.

3. The apparatus as recited in claim 1 wherein said valve is closed to regulate flow of charge through said at least one circuit of said heat rejecting heat exchanger and increase said high pressure of said refrigerant.

4. The apparatus as recited in claim 1 wherein said high pressure is controlled by actuating said valve.

5. The apparatus as recited in claim 1 wherein said refrigerant is carbon dioxide.

6. A transcritical vapor compression system comprising:

a compression device to compress a refrigerant to a high pressure;

a heat rejecting heat exchanger for cooling said refrigerant, said heat rejecting heat exchanger having at least two circuits;

a valve located on at least one said circuit of said heat rejecting heat exchanger actuated to regulate flow of a charge through said heat rejecting heat exchanger;

a controller which monitors said high pressure, determines a desired high pressure, and adjusts said high pressure to said desired high pressure by adjusting said valve;

an expansion device for reducing said refrigerant to a low pressure; and a heat accepting heat exchanger for evaporating said refrigerant.

7. The system as recited in claim 6 wherein said valve is opened to regulate flow of said charge through said at least one circuit of said heat rejecting heat exchanger and decrease said high pressure of said refrigerant.

8. The system as recited in claim 6 wherein said valve is closed to regulate flow of said charge through said at least one circuit of said heat rejecting heat exchanger and increase said high pressure of said refrigerant.

9. The system as recited in claim 6 wherein said high pressure is controlled by actuating said valve.

10. The system as recited in claim 6 wherein said refrigerant is carbon dioxide.

11. A method of regulation of a high pressure of a transcritical vapor compression system comprising the steps of:

providing a heat rejecting heat exchanger for cooling a refrigerant including at least two circuits and at least one valve located on at least one of said circuits;

compressing said refrigerant to said high pressure;

cooling said refrigerant;

expanding said refrigerant;

evaporating said refrigerant;

determining a desired high pressure; and adjusting said high pressure of said refrigerant to said desired high pressure by adjusting said at least one valve.

12. The method as recited in claim 11 wherein the step of adjusting said high pressure comprises opening said valve to regulate flow of charge through said circuit of said heat rejecting heat exchanger to decrease said high pressure of said refrigerant.

13. The method as recited in claim 11 wherein tie step of adjusting said high pressure comprises closing said valve to regulate flow of charge through said circuit of said heat rejecting heat exchanger to increase said high pressure of said refrigerant.

14. The method as recited in claim 11 wherein the refrigerant is carbon dioxide.

* * * * *

UNITED STATES PATENT AND TRADEMARK OFFICE

CERTIFICATE OF CORRECTION

PATENT NO. : 6,418,735 B1
DATED : July 16, 2002
INVENTOR(S) : Sienel

It is certified that error appears in the above-identified patent and that said Letters Patent is hereby corrected as shown below:

Column 4,
Line 59, "tie" should be -- the --

Signed and Sealed this

Third Day of December, 2002

JAMES E. ROGAN
*Director of the United States Patent and Trademark Office*